US006760985B2

(12) United States Patent
Wilson

(10) Patent No.: US 6,760,985 B2
(45) Date of Patent: Jul. 13, 2004

(54) CRAFT HOOP CLAMPING METHOD AND APPARATUS

(75) Inventor: Dave Wilson, Roanoke, IN (US)

(73) Assignee: David A. Wilson, Roanoke, IN (US)

( * ) Notice: Subject to any disclaimer, the term of this patent is extended or adjusted under 35 U.S.C. 154(b) by 0 days.

(21) Appl. No.: 10/234,534

(22) Filed: Sep. 3, 2002

(65) Prior Publication Data

US 2004/0040186 A1 Mar. 4, 2004

(51) Int. Cl.[7] ..... D06C 3/08
(52) U.S. Cl. ..... 38/102.2
(58) Field of Search ..... 38/102, 102.2, 38/102.4, 102.91; 112/103, 121; 74/25, 36, 38, 54

(56) References Cited

U.S. PATENT DOCUMENTS

| | | | | | |
|---|---|---|---|---|---|
| 116,684 | A | | 7/1871 | Cone | |
| 625,573 | A | | 5/1899 | Leavitt | |
| 629,847 | A | * | 8/1899 | Doolittle | 38/102.2 |
| 929,583 | A | * | 7/1909 | Gibbs | 38/102.2 |
| 951,509 | A | * | 3/1910 | Mintel | 38/102.2 |
| 1,098,442 | A | * | 6/1914 | Huyck | 38/102.2 |
| 1,501,203 | A | | 7/1924 | Crossley | |
| 1,740,957 | A | | 12/1929 | Phillips | |
| 1,904,340 | A | | 4/1933 | Wright | |
| 2,453,492 | A | | 11/1948 | Carter | |
| 4,573,717 | A | | 3/1986 | Peacock | |
| 5,193,864 | A | | 3/1993 | Coleman | |
| 5,555,653 | A | | 9/1996 | Morgan | |
| 5,655,469 | A | * | 8/1997 | Herbach et al. | 112/103 |

* cited by examiner

*Primary Examiner*—Ismael Izaguirre
(74) *Attorney, Agent, or Firm*—Taylor & Aust, P.C.

(57) ABSTRACT

A craft hoop assembly including a split hoop having a first end and a second end and a clamping mechanism connected to the first end, the clamping mechanism having a first pivot point and a second pivot point, the first pivot point associated with the first end, the second pivot point associated with the second end.

20 Claims, 6 Drawing Sheets

CRAFT HOOP CLAMPING METHOD AND APPARATUS

BACKGROUND OF THE INVENTION

1. Field of the Invention

The present invention relates to craft hoops, and, more particularly, to a craft hoop clamp.

2. Description of the Related Art

Craft hoops also known as embroidery hoops or knitting rings, generally include concentric inner and outer hoops. The inner hoop has a fixed diameter and the outer hoop has an adjustable diameter. Material, such as fabric, is placed upon the inner hoop while the outer hoop is placed over the fabric and around the inner hoop. The outer hoop is then adjusted such that the outer hoop fits snugly against the material and the inner hoop so as to hold the material between the inner and outer hoops. Craft work is then undertaken on the fabric held between the inner hoop and outer hoop.

Embroidery has been traditionally used to decorate clothing and household furnishings including such items as table linens, towels, bedding and decorative items. Most embroidered products are assembled from several individual pieces of fabric. Prior to assembling each piece of fabric, upon which an embroidered design or logo is to be placed, the fabric is inserted into an embroidery hoop and secured to the hoop. The hoop is then embroidered either by hand or with an embroidery machine.

Embroidery hoops have been known and used in both home and in factories for many years. Spring type embroidery hoops are used for hand and machine operations. Spring type hoops tension the outer hoop entirely by the resilience of the spring. More commonly, embroidery hoops such as circular or oval shaped units have an outer threaded fastener that traverses the split in the outer hoop for tightening the outer hoop against the inner hoop.

The problem with conventional embroidery hoops or craft hoops has been the difficulties with the tensioning mechanism. The screw type tensioning mechanism generally requires the use of two hands to position and tighten the threaded bolt with a wing nut. The disadvantage of the spring type embroidery hoop is that the tension is related only to the spring force and the force from the spring decreases as the hoop is drawn together.

What is needed in the art is a tensioning device which is easily operable with one hand and adjustable to provide variable tension on a craft hoop.

SUMMARY OF THE INVENTION

The present invention provides an adjustable tensioning device for a craft hoop assembly.

The invention comprises, in one form thereof, a craft hoop assembly including a split hoop having a first end and a second end and a clamping mechanism connected to the first end, the clamping mechanism having a first pivot point and a second pivot point, the first pivot point associated with the first end, the second pivot point associated with the second end.

An advantage of the present invention is that a split craft hoop can be secured around an inner hoop using only one hand.

Another advantage is that a conventional outer hoop can be retrofitted with a kit of the present invention.

Yet another advantage is that the craft hoop clamping method provides an adjustable over-center type mechanism for tensioning the outer hoop.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
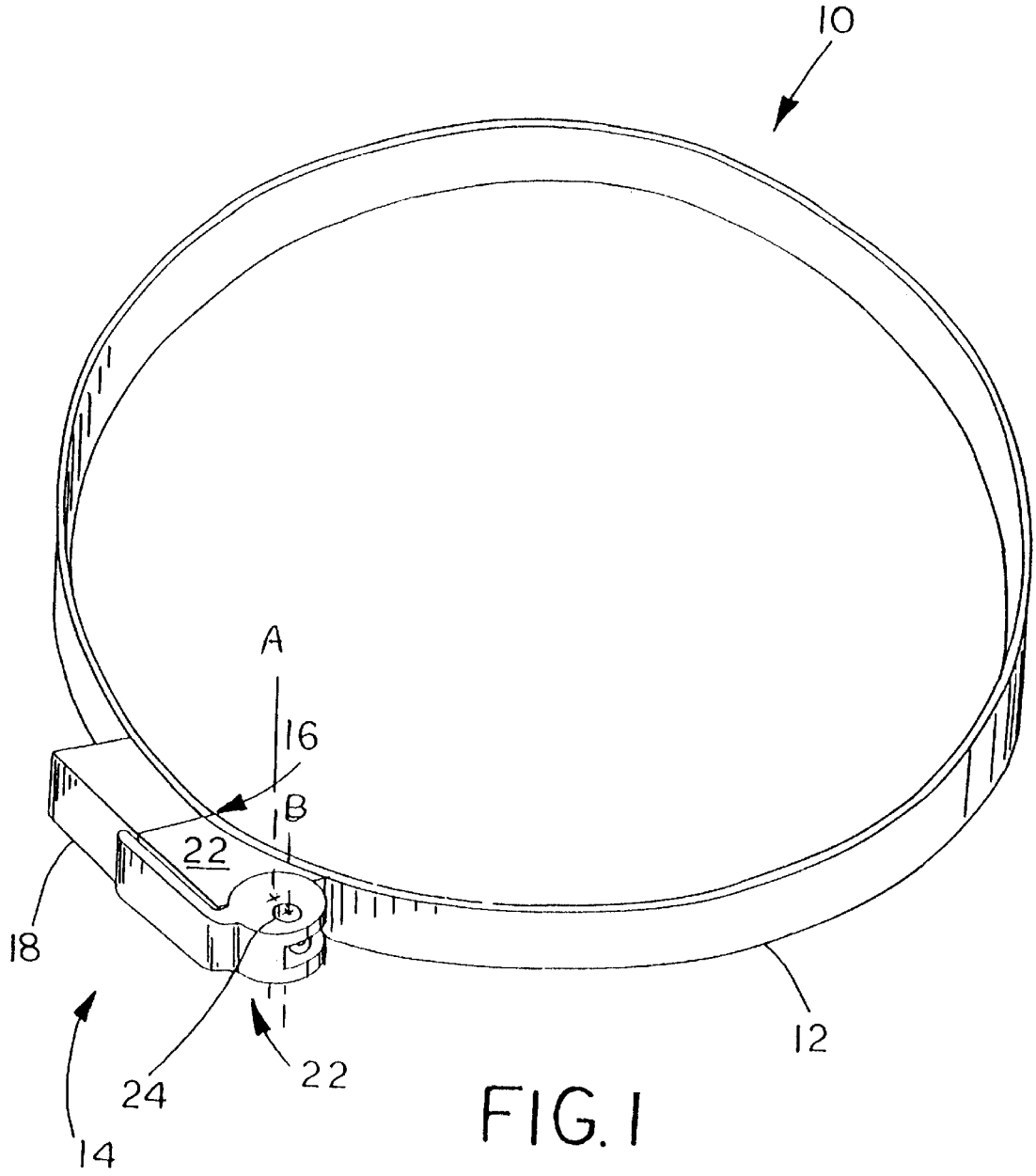
FIG. 1 is a perspective view of an embodiment of a craft hoop clamping apparatus of the present invention.
Figure 2:
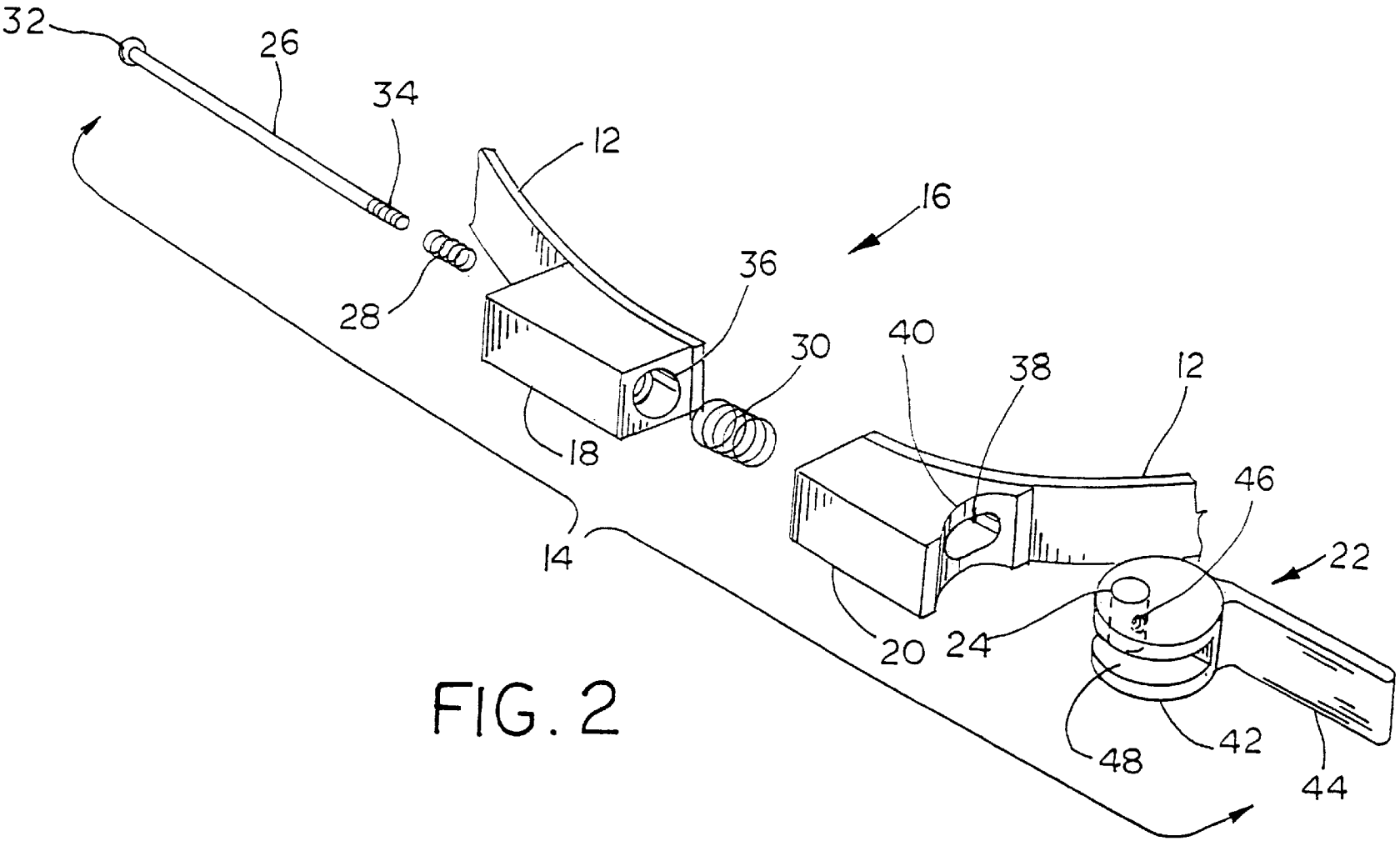
FIG. 2 is an exploded perspective view of the craft hoop clamping apparatus shown in FIG. 1.

Referring now to the drawings, and, more particularly to FIGS. 1 and 2, there is shown an embodiment of a craft hoop clamping apparatus 10 of the present invention, which generally includes split hoop 12 and over-center clamp mechanism 14.

Split hoop 12 is a generally circular hoop that has a split 16 along the circumference thereof. Split hoop 12 may be made from a variety of materials such as wood, plastic or carbon fiber. The inner surface, although shown as smooth in FIG. 1, may include ridges to better grip a fabric. Although split hoop 12 is shown as a circular hoop other shapes such as elliptical or quasi-rectangular may be incorporated as a part of craft hoop clamping apparatus 10. Alternatively, more than one over-center clamp mechanism 14 may be applied along the circumference of a split hoop.

Over-center clamp mechanism 14 includes retaining block 18, recessed block 20, over-center tensioner 22, tensioning rod retainer 24, tensioning rod 26, rod spring 28 and expansion spring 30. Retaining block 18 is attached to one end of split hoop 12 and retaining block 18 is aligned with recessed block 20. Retaining block 18 includes an opening 36 through which tensioning rod 26 is disposed. Tensioning rod 26 is retained by retaining block 18 to thereby provide tension on split hoop 12. Recessed block 20 is attached to another end of split hoop 12 and is aligned with retaining block 18. Recessed block 20 includes elongated opening 38 through which tensioning rod 26 is disposed and recess 40 which serves as a bearing surface for tensioner 22.

Over-center tensioner 22 includes bearing surface 42, handle 44 and slot 48. Axis A and axis B denote two pivot points about which portions of over-center tensioner 22 rotate. Bearing surface 42 contacts recess 40 to provide pressure against recessed block 20, thereby placing tension on split hoop 12. Bearing surface 42 is part of a circumference of a substantially circular portion of over-center tensioner 22 that rotates about axis A. Handle 44 provides a mechanical advantage to over-center tensioner 22 and allows an operator to thereby put pressure on tensioning rod 26. In a preferred embodiment of the present invention handle 44 exceeds two inches in length. Threaded portion 46 of tensioning rod retainer 24 engages tensioning rod 26 in an adjustable manner. Tensioning rod retainer 24 is retained in over-center tensioner 22 by the connection with tensioning rod 26. Tensioning rod retainer 24 rotates about axis B such that when handle 44 is moved to a position adjacent to recessed block 20, that tensioning rod 26 crosses axis A, thereby biasing handle 44 to remain adjacent to recessed block 20. Such an arrangement is known as an over-center condition. Slot 48 allows space for tensioning rod 26 to travel when over-center tensioner 22 is rotated. Tensioning rod retainer 24 is positioned off center relative to bearing surface 42 to provide a camming type action as over-center tensioner 22 is rotated. Over-center tensioner 22 can be in the form of a cam clamp or a toggle clamp.

Tensioning rod 26 includes a retaining end 32 in the form of a ball 32 on one end thereof and a threaded end 34 on an opposite end thereof. Retaining end 32 has a retaining surface for rod spring 28 to rest against. The portion of retaining end 32 directed away from tensioning rod 26 may include a tab that protrudes or a slot therein, thereby accommodating a rotational adjustment of tensioning rod 26. Rod spring 28 is positioned on tensioning rod 26 prior to tensioning rod 26 being inserted into retaining block 18. Rod spring 28 comes into contact with a surface of retaining block 18 and provides tension within over-center clamp mechanism 14 while it is unlatched. Tensioning rod 26 traverses the inner diameter of expansion spring 30, which is positioned between retaining block 18 and recessed block 20. Expansion spring 30 is positioned to cause split hoop 12 to part along split 16 when tension on tensioning rod 26 is released. Tensioning rod 26 also is disposed through elongated opening 38 of recessed block 20. Threaded end 34 adjustably engages threaded portion 46 of tensioning rod retainer 24. Tensioning rod 26, also known as tensioning member 26, may be embodied as a flexible member such as a cable with retaining end 32 connected thereto.

Alternatively, over-center clamp mechanism 14 may be configured to provide a compressive force on an inner split hoop. The compressive force is exerted against an outer hoop.

Figure 3:
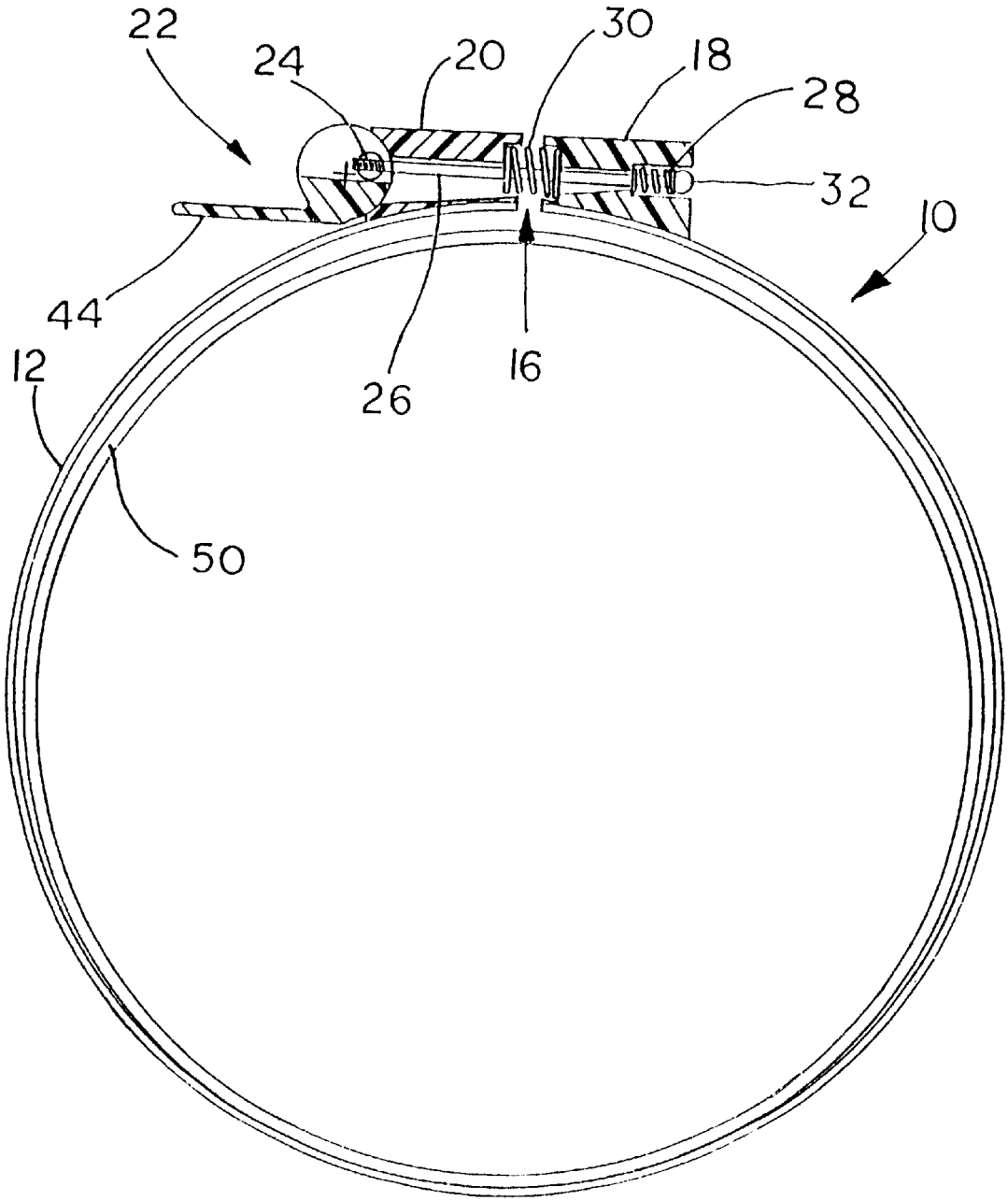
FIG. 3 is a partially sectionalized view of the craft hoop clamping apparatus shown in FIGS. 1 and 2.
Figure 4:
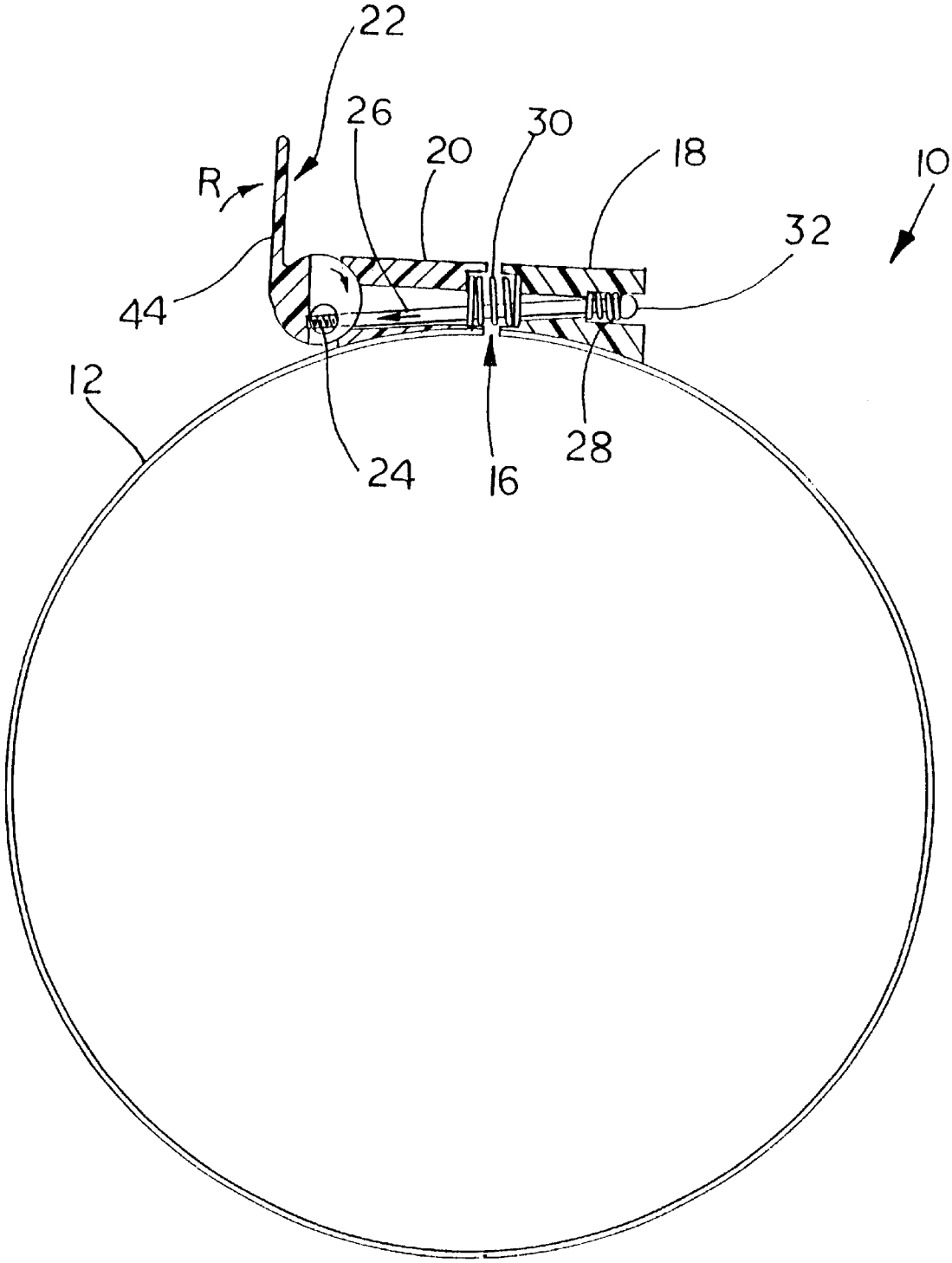
FIG. 4 is a partially sectionalized view of the craft hoop clamping apparatus shown in FIGS. 1–3.
Figure 5:
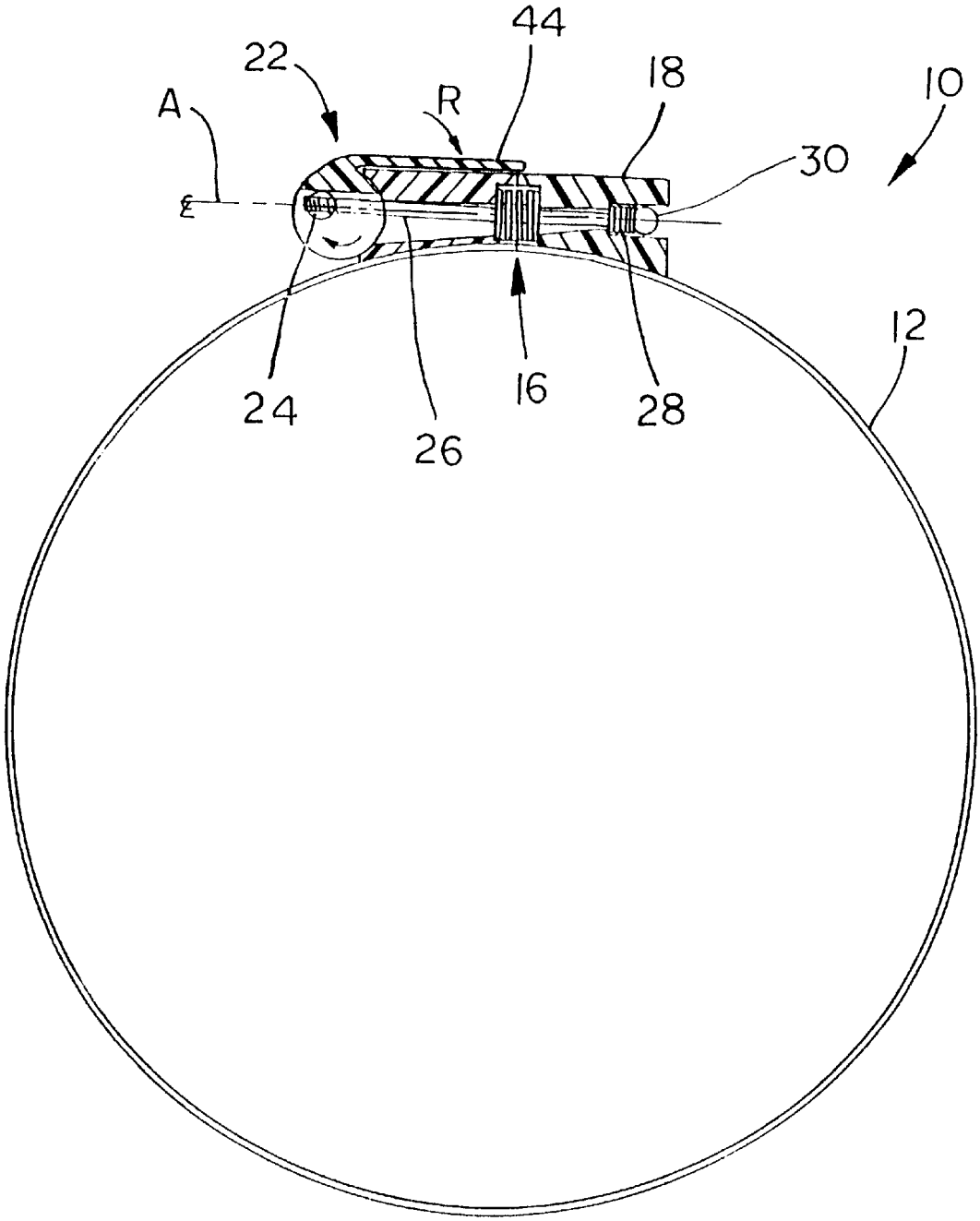
FIG. 5 is a partially sectionalized side view of the craft hoop clamping apparatus of FIGS. 1–4.

Now, additionally referring to FIGS. 3–5, there is shown the operation of craft hoop clamping apparatus 10. In FIG. 3 there is shown inner hoop 50 surrounded with craft hoop assembly 10 in an unlatched position. As handle 44 of over-center tensioner 22 is rotated in direction R tensioning rod 26 is drawn against retaining block 18 causing split 16 to narrow. As over-center tensioner 22 is rotated tensioning rod 26, as shown in FIG. 4, is angularly offset. As shown in FIG. 5 over-center tensioner 22 is in a latched position, with tensioning rod 26 being slightly above centerline A thereby keeping over-center tensioner 22 in the latched position. Split 16 is substantially reduced in width when over-center clamp mechanism 14 is in the latched position, thereby causing split hoop 12 to be drawn tight against inner hoop 50.

Craft hoop assembly 10 is operated by placing over-center tensioner 22 in an unlatched position. Fabric is placed over inner hoop 50 and arranged as required by the user who may be an embroiderer or quilter. Outer hoop 12 is then placed over the fabric locating outer hoop 12 substantially concentric with inner hoop 50. Over-center tensioner 22 is then rotated, thereby placing tension on tensioning rod 26, causing split hoop 12 to close split 16 and securing tension against the fabric placed over inner hoop 50. Over-center tensioner 22 is rotated until it is in a latched position to securely hold the fabric placed over inner hoop 50. Retaining rod 26 is adjustable within tensioning rod retainer 24 thereby providing an adjustable amount of tension on split hoop 12.

Figure 6:
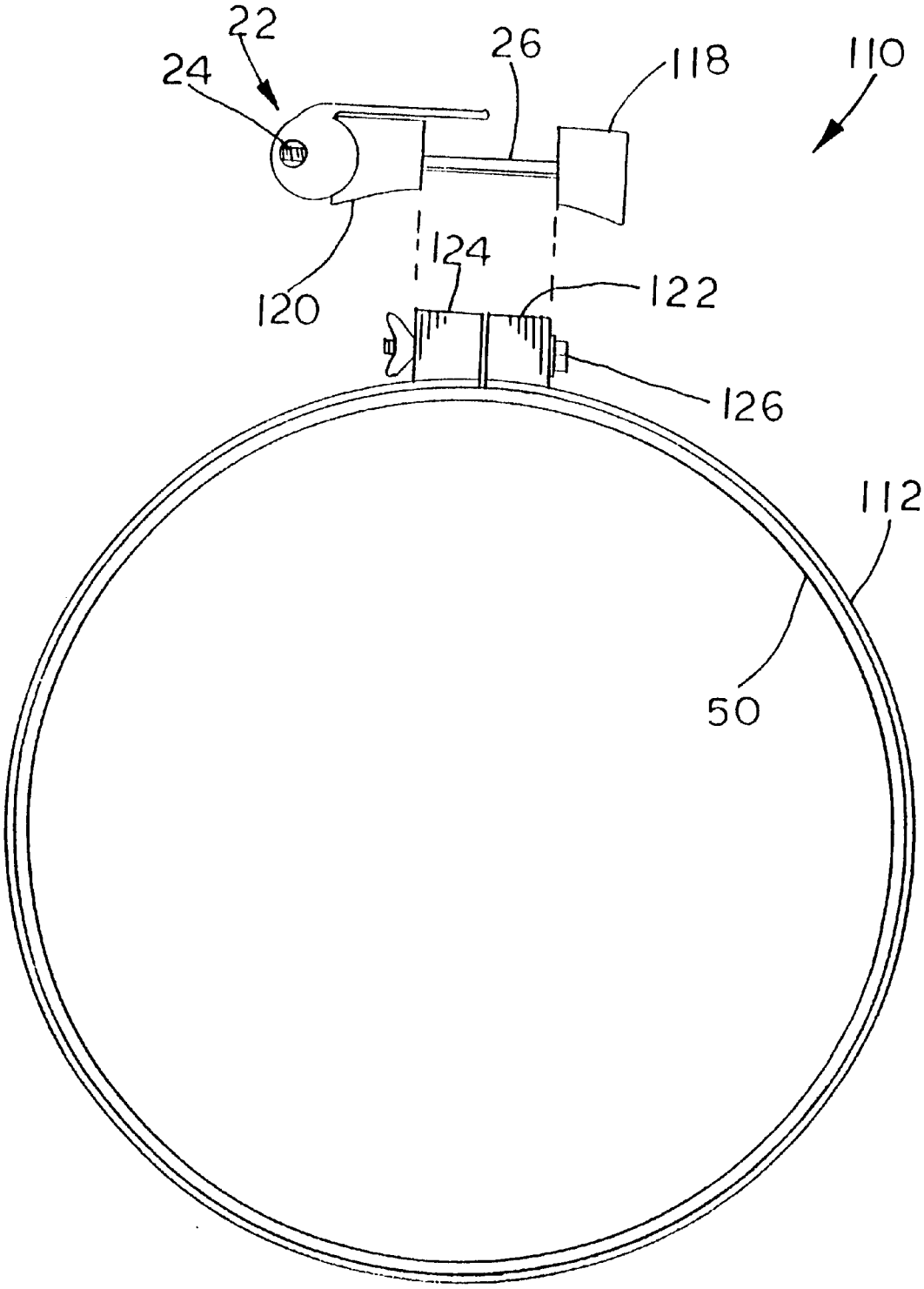
FIG. 6 is a view of another embodiment of the clamping apparatus in the form of a kit for a conventional craft hoop assembly.

Now, additionally referring to FIG. 6, there is illustrated another embodiment of the present invention in the form of a craft hoop clamping kit 110 shown with a conventional craft hoop. A conventional craft hoop includes outer split hoop 112, protrusion 122, protrusion 124 and a bolt with wing nut 126. Protrusions 122 and 124 are respectively connected to an end of split hoop 112 and bolt/wing nut 126 is disposed therethrough, the combination thereby accommodating the tensioning of split hoop 112. Craft hoop clamping kit 110, which is substantially similar to over-center clamp mechanism 14, is installed by first removing winged bolt 126 from protrusions 122 and 124. Retaining rod 26 is unscrewed from tensioning rod retainer 24. Tensioning rod 26 is then routed through protrusions 122 and 124 where bolt 126 had been and tensioning rod 26 is then re-threaded into tensioning rod retainer 24. Retaining block 118 and recessed block 120 are shortened versions of retaining block 18 and recessed block 20 of the previous embodiment. The surface of recess block 120 that bears upon protrusion 124 is slidingly engaged to allow tensioner 22 to operate in a camming type manner.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A craft hoop assembly, comprising:

a split hoop having a first end and a second end; and a clamping mechanism connected to said first end, said clamping mechanism having a first pivot point and a second pivot point, said first pivot point associated with said first end, said second pivot point associated with said second end said clamping mechanism including a handle connected to said first pivot point and said second pivot point.

2. The assembly of claim 1, further comprising a tensioning member having a first end and a second end, said first end of said tensioning member connected to said second end of said split hoop said second end of said tensioning member being associated with said second pivot point.

3. The assembly of claim 2, wherein said second end of said tensioning member is adjustably connected to said second pivot point.

4. The assembly of claim 3, wherein said tensioning member is a tensioning rod.

5. The assembly of claim 4, wherein said second pivot point includes a retainer adjustably connected to said second end of said tensioning rod.

6. The assembly of claim 4, wherein said clamping mechanism has a latched position and an unlatched position, said clamping mechanism holding said tensioning rod in an over-center position when said clamping mechanism is in said latched position.

7. The assembly of claim 6, wherein said clamping mechanism is one of a cam clamp and a toggle clamp.

8. The assembly of claim 1, further comprising an inner hoop, said split hoop disposed around said inner hoop.

9. The assembly of claim 1, wherein said handle exceeds two inches in length.

10. A craft hoop assembly comprising:

a split hoop having a first end and a second end;

a clamping mechanism connected to said first end, said clamping mechanism having a first pivot point and a second pivot point, said first pivot point associated with said first end, said second pivot point associated with said second end;

a tensioning rod having a first end and a second end, said first end of said tensioning rod connected to said second end of said split hoop said second end of said tensioning rod being associated with said second pivot point, said second end of said tensioning rod is adjustably connected to said second pivot point; and a recessed block disposed proximate to said clamping mechanism, said recessed block having a recessed bearing surface to interact with said clamping mechanism, said recessed block being attached to said first end of said split hoop.

11. The assembly of claim 10, further comprising a retaining block attached to said second end of said split hoop, said first end of said tensioning rod being retained by said retaining block.

12. The assembly of claim 11, further comprising at least one coil spring disposed around a portion of said tensioning rod.

13. A craft hoop latching kit for retrofitting a conventional craft hoop, comprising:

a tensioning rod having a first end and a second end;

an over-center tensioner adjustably connected to said first end; and a recessed block disposed proximate to said over-center tensioner, said recessed block providing a recessed bearing surface to interact with said over-center tensioner, said recessed block having an other surface that abuts a protrusion from the conventional craft hoop.

14. The kit of claim 13, wherein said over-center tensioner further comprises a retainer adjustably connected to said first end of said tensioning rod, said retainer pivotally associated with said over-center tensioner.

15. The kit of claim 13, wherein said over-center tensioner has a latched position and an unlatched position, said over-center tensioner holding said tensioning rod in an over-center position in said latched position.

16. The kit of claim 13, further comprising a retaining block having a surface that abuts an other protrusion of the conventional craft hoop, said second end of said tensioning rod being retained by said retaining block.

17. The kit of claim 16, wherein said tensioner is one of a cam clamp and a toggle clamp.

18. A method of retaining fabric in a craft hoop, comprising the steps of:

positioning the fabric over an inner hoop;

concentrically placing a split outer hoop over the fabric and said inner hoop, said split outer hoop having a first end and a second end;

providing a clamping mechanism having a first pivot point and a second pivot point, said first pivot point associated with said first end, said second pivot point associated with said second end, said clamping mechanism including a handle connected to said first pivot point and said second pivot point; and tensioning said split outer hoop against said inner hoop with said clamping mechanism.

19. The method of claim 18, wherein said clamping mechanism is one of a cam clamp and a toggle clamp.

20. The method of claim 18, further comprising the step of adjusting a tensioning rod having a first end and a second end, said first end of said tensioning rod being adjustably connected to said second pivot point, said second end of said tensioning rod being connected to said second end of said split hoop.

* * * * *